US012514332B2

(12) United States Patent
Udaskin

(10) Patent No.: US 12,514,332 B2
(45) Date of Patent: Jan. 6, 2026

(54) REARFOOT SUPPORT DEVICE

(71) Applicant: 2752590 Ontario Inc., Toronto (CA)

(72) Inventor: Avrum Udaskin, Toronto (CA)

(73) Assignee: 2752590 Ontario Inc., Toronto (CA)

( * ) Notice: Subject to any disclaimer, the term of this patent is extended or adjusted under 35 U.S.C. 154(b) by 238 days.

(21) Appl. No.: 17/313,974

(22) Filed: May 6, 2021

(65) Prior Publication Data

US 2021/0345730 A1 Nov. 11, 2021

Related U.S. Application Data

(60) Provisional application No. 63/021,275, filed on May 7, 2020.

(51) Int. Cl.
*A43B 21/32* (2006.01)
*A43B 7/20* (2006.01)

(52) U.S. Cl.
CPC ..... *A43B 21/32* (2013.01); *A43B 7/20* (2013.01)

(58) Field of Classification Search
CPC ..... A43B 21/32; A43B 7/144; A43B 7/16; A43B 7/38; A43B 7/28; A43B 7/20; A61F 5/0111
USPC ..... 36/140–182, 69, 68
See application file for complete search history.

(56) References Cited

U.S. PATENT DOCUMENTS 1,972,899 A * 9/1934 Odell ..... A43B 21/32 36/140
2,821,032 A * 1/1958 Helfet ..... A43B 21/32 36/154
3,613,274 A * 10/1971 Willey ..... A43B 23/17 36/58.5
4,325,380 A * 4/1982 Malkin ..... A43B 21/32 36/140
4,821,430 A * 4/1989 Flemming ..... A43B 23/17 36/68
5,449,005 A 9/1995 Echols
(Continued)

FOREIGN PATENT DOCUMENTS

CN 2825026 10/2006
EP 0468351 A1 1/1992

OTHER PUBLICATIONS

CIPO as International Searching Authority, International Search Report and Written Opinion for PCT/CA2021/050639, Aug. 12, 2021.

(Continued)

*Primary Examiner* — Marie D Bays
(74) *Attorney, Agent, or Firm* — Perkins Coie LLP

(57) ABSTRACT

A rearfoot support device is provided that extends upwards on both medial and lateral sides of the heel in order to stabilize the subtalar joint in a neutral position and reduce medial longitudinal arch collapse. The device supports the subtalar joint by cradling the heel on the medial and lateral sides to prevent the subtalar joint from deviating excessively from the neutral position. Unlike conventional orthotic support devices, the rearfoot support device includes a clamp closure system to accommodate different foot widths, which securely clamp the device to the rearfoot of a user and support the subtalar joint without the need for fasteners or wrapping around the midfoot or dorsum of the foot. The device fits securely to the heel and rearfoot, and can be worn barefoot, with backless footwear or with enclosed footwear to provide improved subtalar joint motion control.

16 Claims, 21 Drawing Sheets

(56) References Cited

U.S. PATENT DOCUMENTS

| | | | | |
|---|---|---|---|---|
| 5,611,153 | A * | 3/1997 | Fisher | A43B 7/143 36/43 |
| 5,714,229 | A * | 2/1998 | Ogden | A43B 17/14 428/116 |
| 5,729,912 | A | 3/1998 | Gutkowski et al. | |
| 5,810,754 | A | 9/1998 | Kenosh | |
| 5,842,294 | A | 12/1998 | Fabricant | |
| 6,245,035 | B1 | 6/2001 | Schrijver | |
| 7,168,188 | B2 | 1/2007 | Auger et al. | |
| 7,472,495 | B2 | 1/2009 | Milbourn | |
| 8,020,317 | B1 * | 9/2011 | Sokolowski | A43B 23/17 36/105 |
| 8,622,946 | B2 * | 1/2014 | Ingimundarson | A61F 5/0127 602/65 |
| 9,232,831 | B2 | 1/2016 | Kimura et al. | |
| 2004/0194348 | A1 | 10/2004 | Campbell et al. | |
| 2008/0178495 | A1 * | 7/2008 | Stein | A61F 5/0111 36/140 |
| 2014/0007456 | A1 * | 1/2014 | Tadin | A43B 7/16 36/43 |
| 2018/0352897 | A1 | 12/2018 | Tambert | |

OTHER PUBLICATIONS

Petask, Amazon.ca product page for Plantar Fasciitis Treatment, Heel Pain Relief Protectors Foot Inserts for Achilles Tendonitis Tendon, Spurs, Fascia Support, Sore Feet, Bruised Foot Cracked Heels for Women, downloaded from https://www.amazon.ca/Fasciitis-Treatment-Protectors-Achilles-Tendonitis/dp/B07J9ZW7YB, Aug. 15, 2019.

Tuli's, Amazon.ca product page fro Tuli's Heavy Duty Heel Cups Large, downloaded from https://www.amazon.ca/Medi-Dyne-Tulis-Heavy-Shock-Absorbers/dp/B000MSZT7O, Aug. 15, 2019.

* cited by examiner

REARFOOT SUPPORT DEVICE

TECHNICAL FIELD

The embodiments disclosed herein relate to orthotics, and, in particular to a standalone footwear article that is designed to provide secure anatomical support to the rearfoot when used alone or worn with footwear.

INTRODUCTION

Traditional Root Theory, often known as Subtalar Joint Neutral Theory, has great clinical popularity in North America and is utilized in most podiatry and orthopedic literature. Root Theory states that the subtalar joint, (STJ) should be in a neutral position in order to allow the key functions of the foot to operate allowing for normal ambulation. Most importantly, when the STJ is in a neutral position, it allows for the foot to transform from a mobile adaptor, to a rigid lever, by locking the midtarsal joint which stabilizes the medial arch of the foot, preventing excessive pronation from occurring and allowing for effective propulsion with each step.

In orthopedic footwear that is designed and built to provide anatomical and structural support to a foot that exhibits excessive pronation or supination, one of the key components that have been shown to impact overall foot motion and support, is the heel counter of the shoe. The heel counter is normally a plastic insert/support that extends upwards from the plantar aspect of the shoe, usually built within the quarter of the shoe, which cradles the foot on the sides and back of the heel to provide support to the foot superiorly from the plantar aspect of the foot. The shape of the orthopedic insole and last curvature can only influence surface contact and weight distribution of the foot and therefore support for motion of the subtalar joint requires support higher up than simply supporting the rear foot positioning and arch positioning from the plantar aspect of the foot.

In many casual and fashionable footwear applications, reinforced and supportive heel counters are not present, and in particular, in barefoot activities and most warm weather footwear such as flip flops and other sandals, provide little or no support compared to a traditional shoe heel counter. This can cause inflammation of the plantar fascia (i.e. plantar fasciitis) leading to discomfort.

In a standard shoe containing a heel counter, the support is realized through the shape and stiffness of the materials used in the heel counter, as well as the closure system across the opening of the vamp of the shoe. When the shoe closure system is secured across the foot, it naturally pulls the heel counter inwards on the heel, creating a closer fit to the heel and thereby helping provide more support as well as securing the heel of the shoe to the wearer and thereby ensuring the heel does not slip out of the shoe.

In a barefoot application however, in order to secure a standalone heel counter to the foot, it would require a closure system across the dorsum of the foot, and this type of application exists in other ankle bracing apparatuses.

Accordingly, there is a need for a device to provide rearfoot stability to the user, that can be worn with or without footwear yet provide similar medial and lateral stability as a heel counter of a shoe, without the need for a closure system that wraps around the dorsal aspect of the midfoot.

SUMMARY

A rearfoot support device is provided that extends upwards on both medial and lateral sides of the heel in order to stabilize the subtalar joint in a neutral position and reduce medial longitudinal arch collapse. The device supports the subtalar joint by cradling the heel on the medial and lateral sides to prevent the subtalar joint from deviating excessively from the neutral position. Unlike conventional orthotic support devices, the rearfoot support device includes a clamp closure system to accommodate different foot widths, which securely clamp the device to the rearfoot of a user and support the subtalar joint without the need for fasteners or wrapping around the midfoot or dorsum of the foot. The device fits securely to the heel and rearfoot, and can be worn barefoot, with backless footwear or with enclosed footwear to provide improved subtalar joint motion control.

According to an embodiment, there is a rearfoot support device comprising: a base for supporting the heel of a user, the base comprising: a lateral section for supporting a lateral rearfoot of the user; a medial section for supporting a medial rearfoot of the user. The rearfoot support device is absent a front foot support. The device includes a clamp mechanism for moving the lateral section relative to the medial section; a pair of opposable concave support members for supporting the subtalar joint of a user, the pair of support members comprising: a lateral support member disposed on the lateral section; and a medial support member disposed on the medial section; wherein the base and the support members form a clamp for attaching the support device to the rearfoot of a user.

According to some embodiments of the rearfoot support device, the clamp mechanism includes a projection on the lateral section, wherein the projection includes a plurality of teeth spaced at increments, and a cavity in the medial section, wherein the cavity includes a spring-biased pawl for engaging the teeth.

According to some embodiments of the rearfoot support device, the width of the base may be adjusted by moving the lateral section relative to the medial section upon depressing the lever arm.

According to some embodiments of the rearfoot support device may be absent a back heel.

According to some embodiments of the rearfoot support device, a distance between the opposable support members is correspondingly adjusted by moving the lateral section relative to the medial section.

According to some embodiments of the rearfoot support device, the pawl is spring-biased to prevent the lateral section and medial section from moving apart.

According to some embodiments, the rearfoot support device further comprises a lever arm connected to the spring-biased pawl, wherein upon depressing the lever arm the spring-bias is overcome allowing for the support members to move apart.

According to some embodiments of the rearfoot support device, the support members include concave surfaces shaped to fit the contours of the calcaneus as it narrows in width superiorly between the malleolus and the widest parts of the calcaneus.

According to some embodiments of the rearfoot support device, the concave surfaces of the support members are coated with a material having a high coefficient of friction. According to some embodiments, the material is ethylene vinyl acetate.

According to some embodiments of the rearfoot support device, an interface between each of the support members and the lateral section and the medial section is shaped to fit the contours of a user's heel.

According to some embodiments of the rearfoot support device, the teeth are spaced at increments corresponding to shoe sizes.

According to some embodiments of the rearfoot support device, the base comprises a posterior end shaped to fit into a heel of footwear.

According to some embodiments of the rearfoot support device, the base comprises a bottom coated with a material having a high coefficient of friction.

Other aspects and features will become apparent, to those ordinarily skilled in the art, upon review of the following description of some exemplary embodiments.

BRIEF DESCRIPTION OF THE DRAWINGS

The drawings included herewith are for illustrating various examples of articles, methods, and apparatuses of the present specification. In the drawings.

DETAILED DESCRIPTION

Various apparatuses or processes will be described below to provide an example of each claimed embodiment. No embodiment described below limits any claimed embodiment and any claimed embodiment may cover processes or apparatuses that differ from those described below. The claimed embodiments are not limited to apparatuses or processes having all of the features of any one apparatus or process described below or to features common to multiple or all of the apparatuses described below.

References herein to "anterior", "posterior", "lateral", "medial" and "superior" should be given their normal meanings according to the standard anatomical terms of location, unless otherwise specified.

Figure 1:
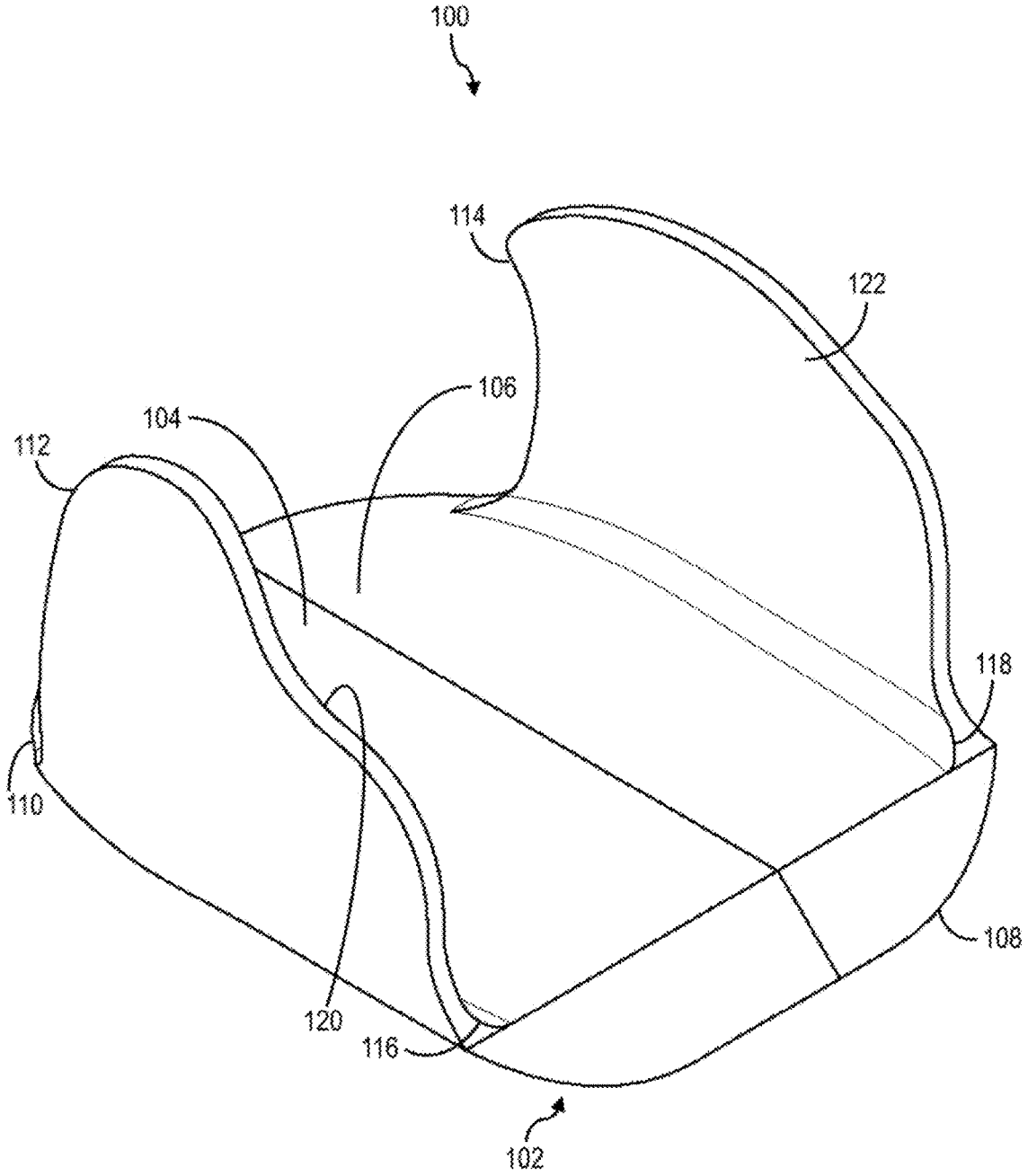
FIG. 1 is a perspective view of a rearfoot support device according to an embodiment.
Figure 2:
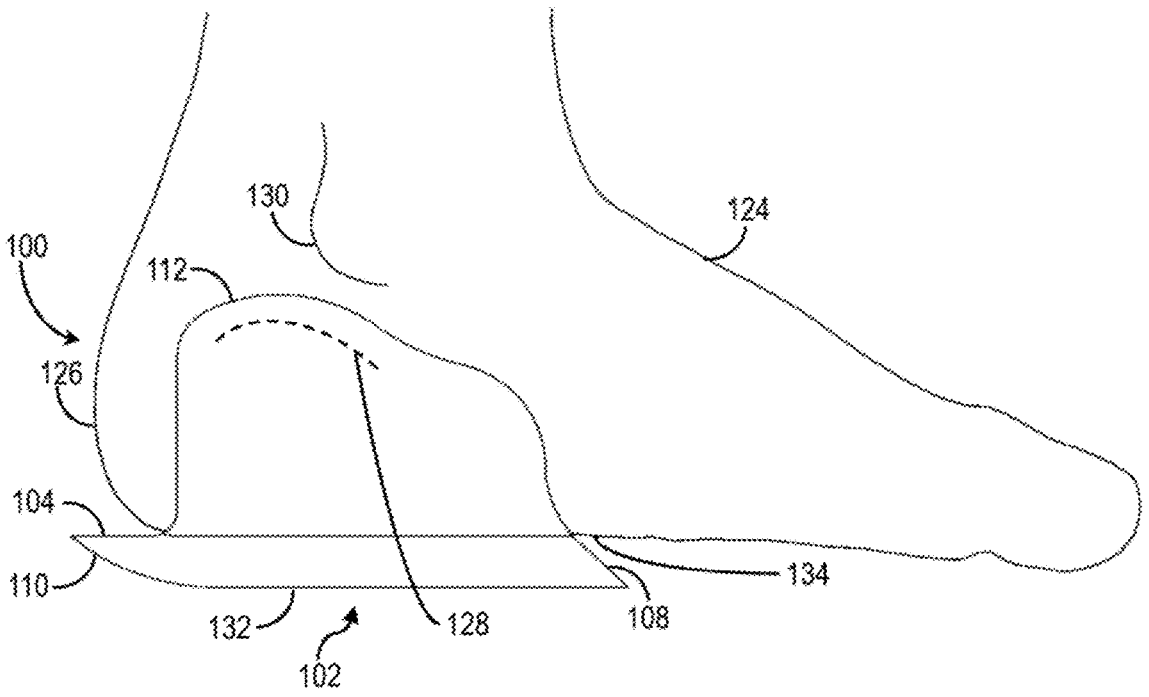
FIG. 2 is a side view of the support device of FIG. 1, shown in relation to a user's foot.
Figure 3:
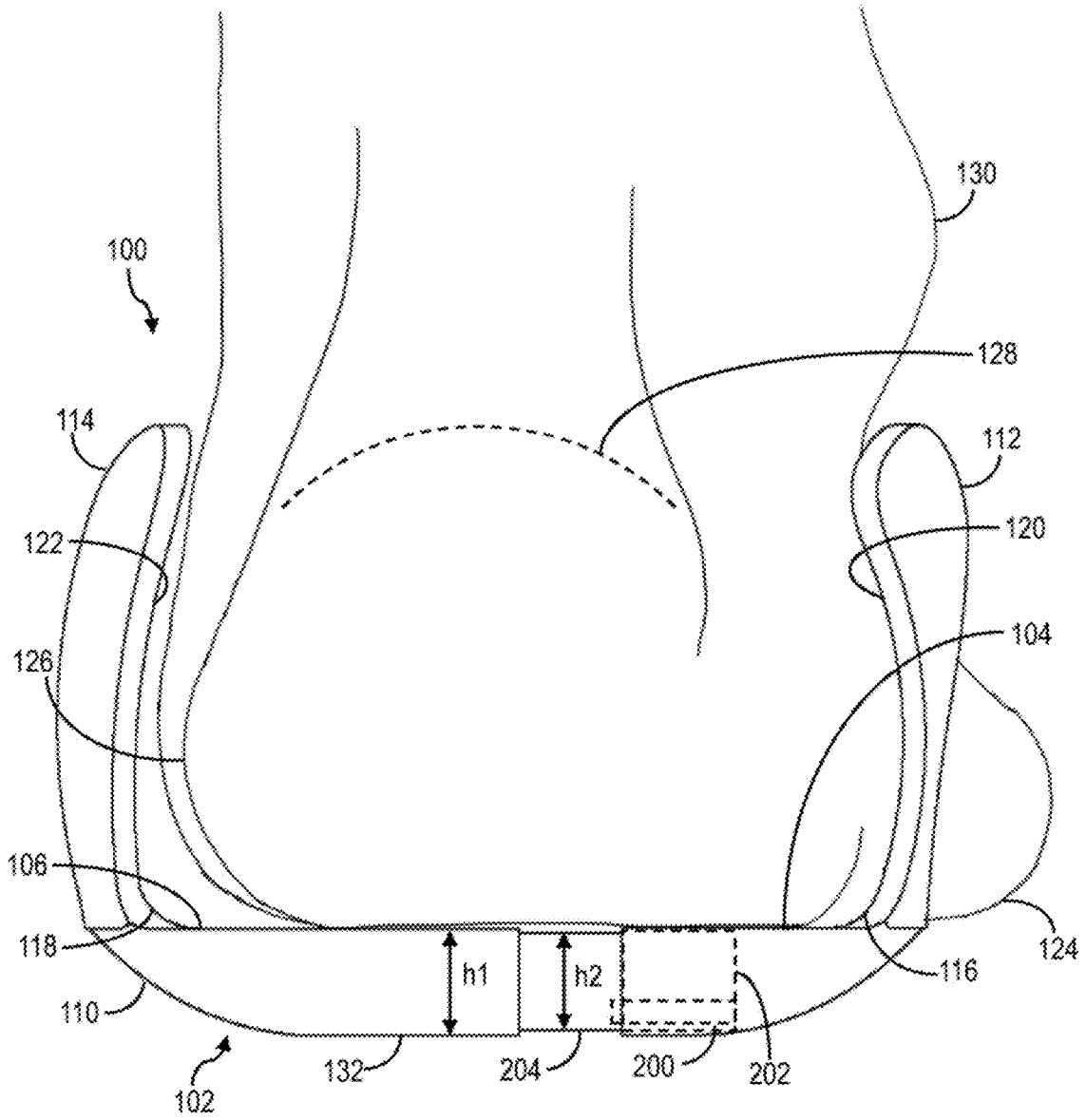
FIG. 3 is a rear view of the support device of FIG. 1, shown in relation to a user's foot.

Referring to FIGS. 1-3, illustrated therein is a perspective view (FIG. 1), a side view (FIG. 2) and a rear view (FIG. 3) of a rearfoot support device 100, according to an embodiment.

The support device 100 includes a base 102 for supporting the rearfoot of a user. The base 102 is both waterproof and sweatproof. The base 102 is substantially rigid with the overall base thickness being a minimum of ~1 mm.

Figure 7:
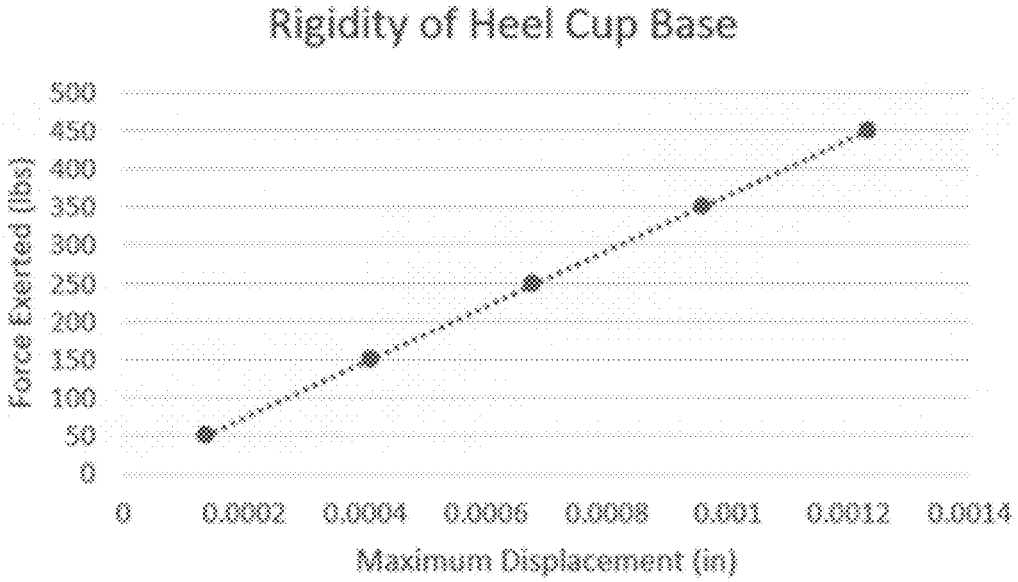
FIG. 7 is a chart showing the rigidity of the base as displacement vs. force.
Figure 8A:
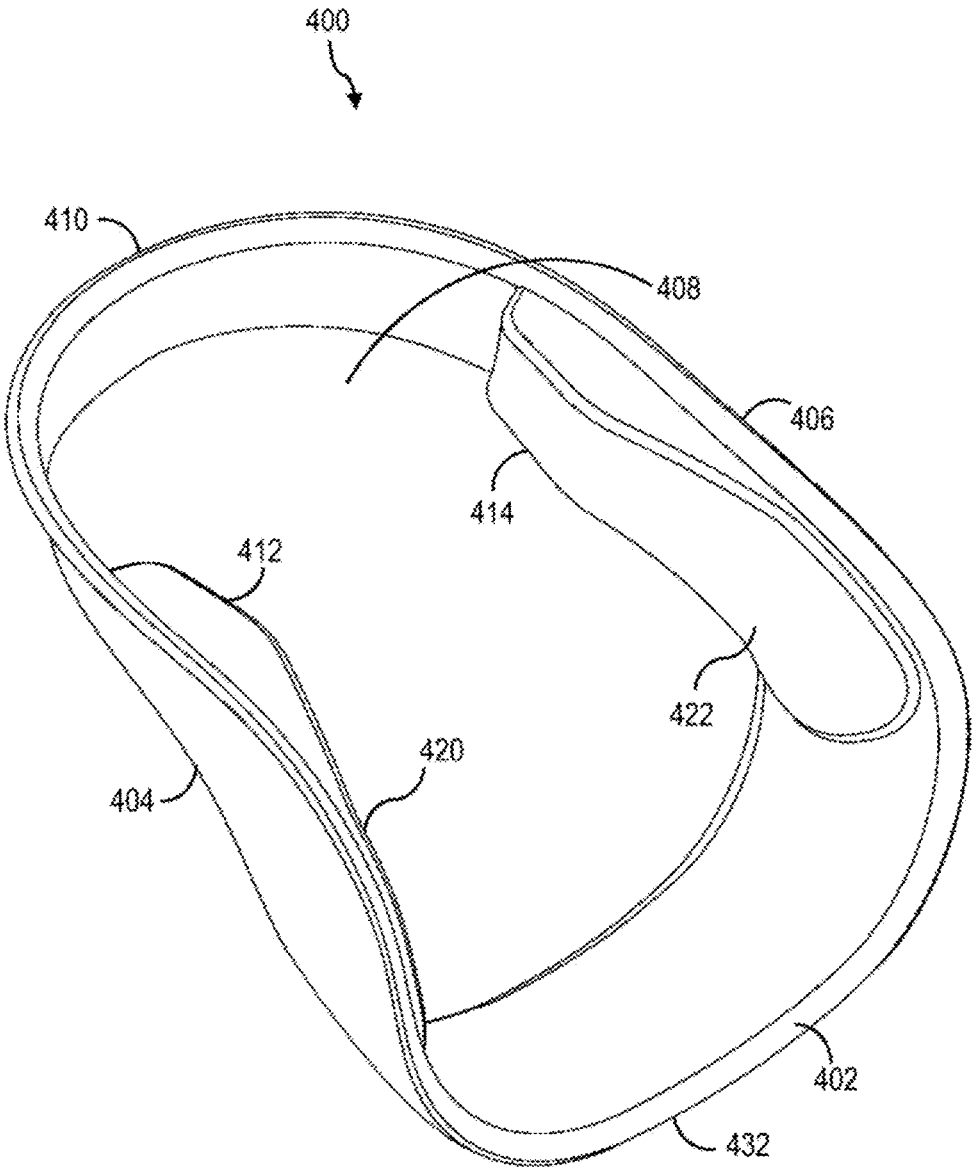
FIG. 8A is a perspective view of a rearfoot support device, according to an embodiment.
Figure 8B:
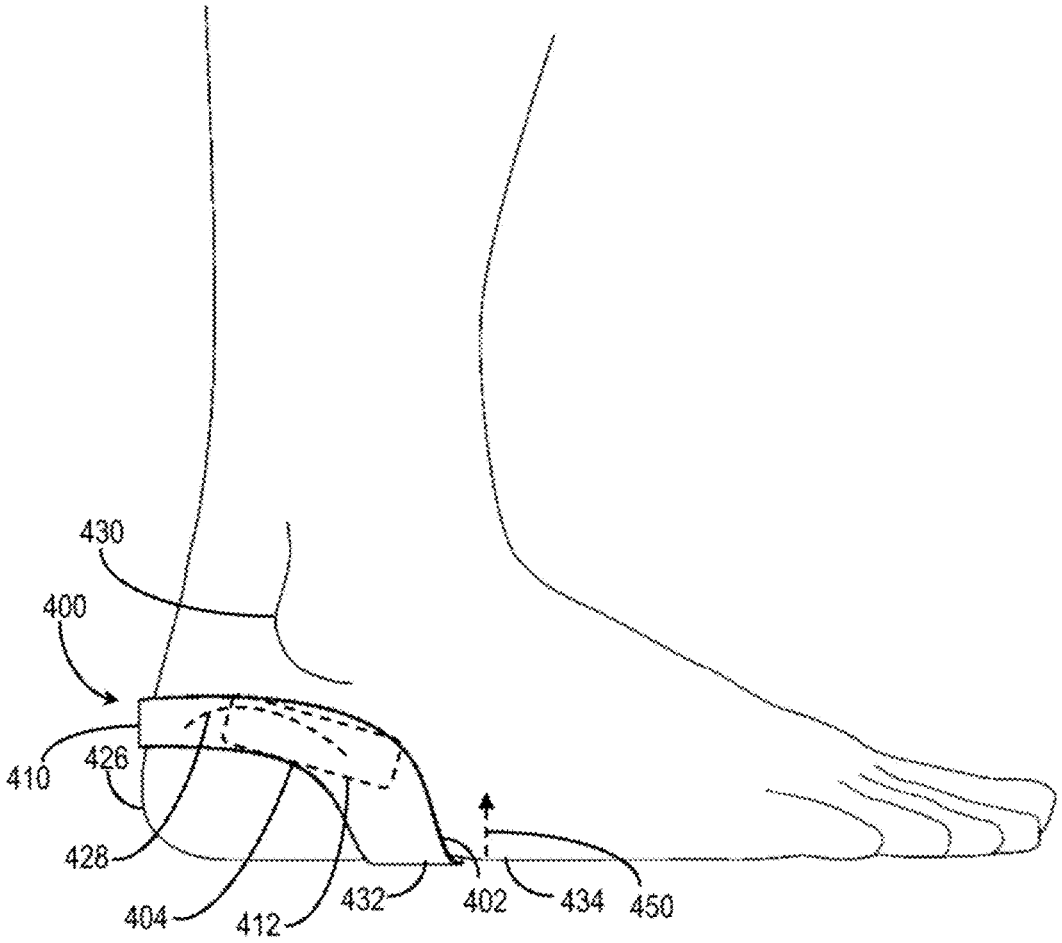
FIG. 8B is a side view of the support device of FIG. 8A, shown in relation to a user's foot.
Figure 8C:
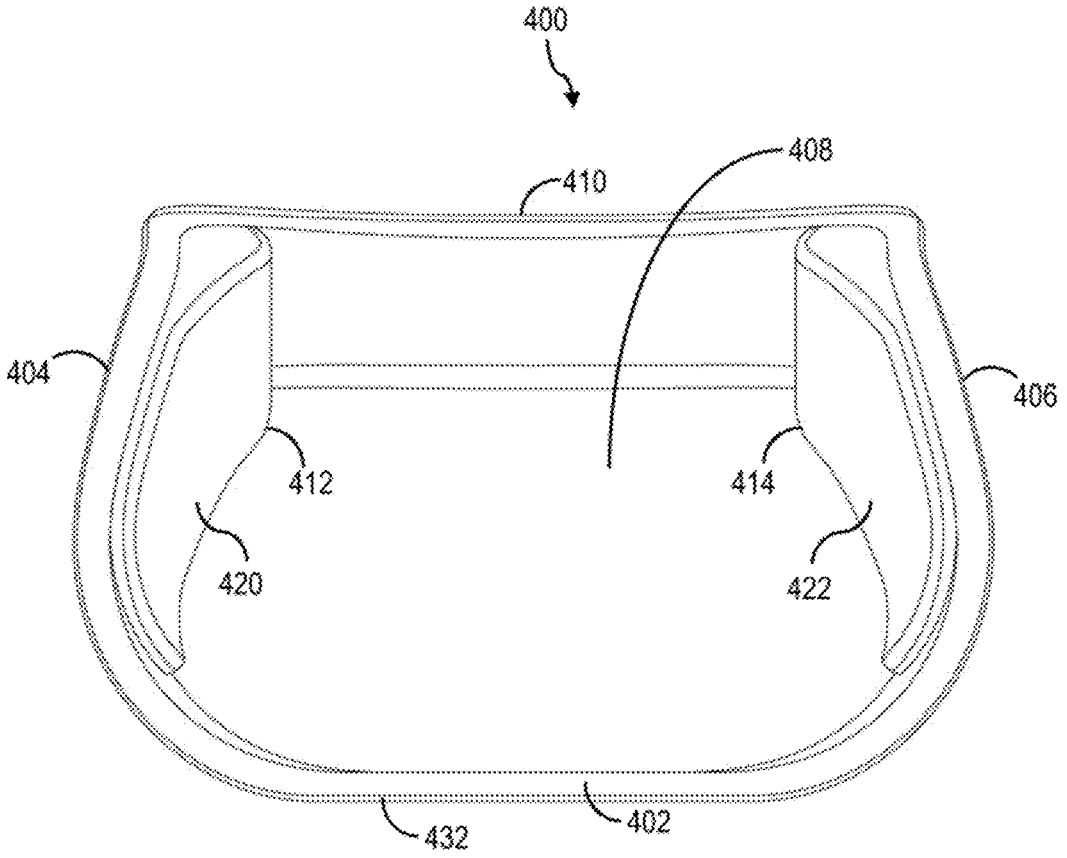
FIGS. 8C-8E are front, top and bottom views, respectively, of the support device of FIG. 8A.
Figure 8D:
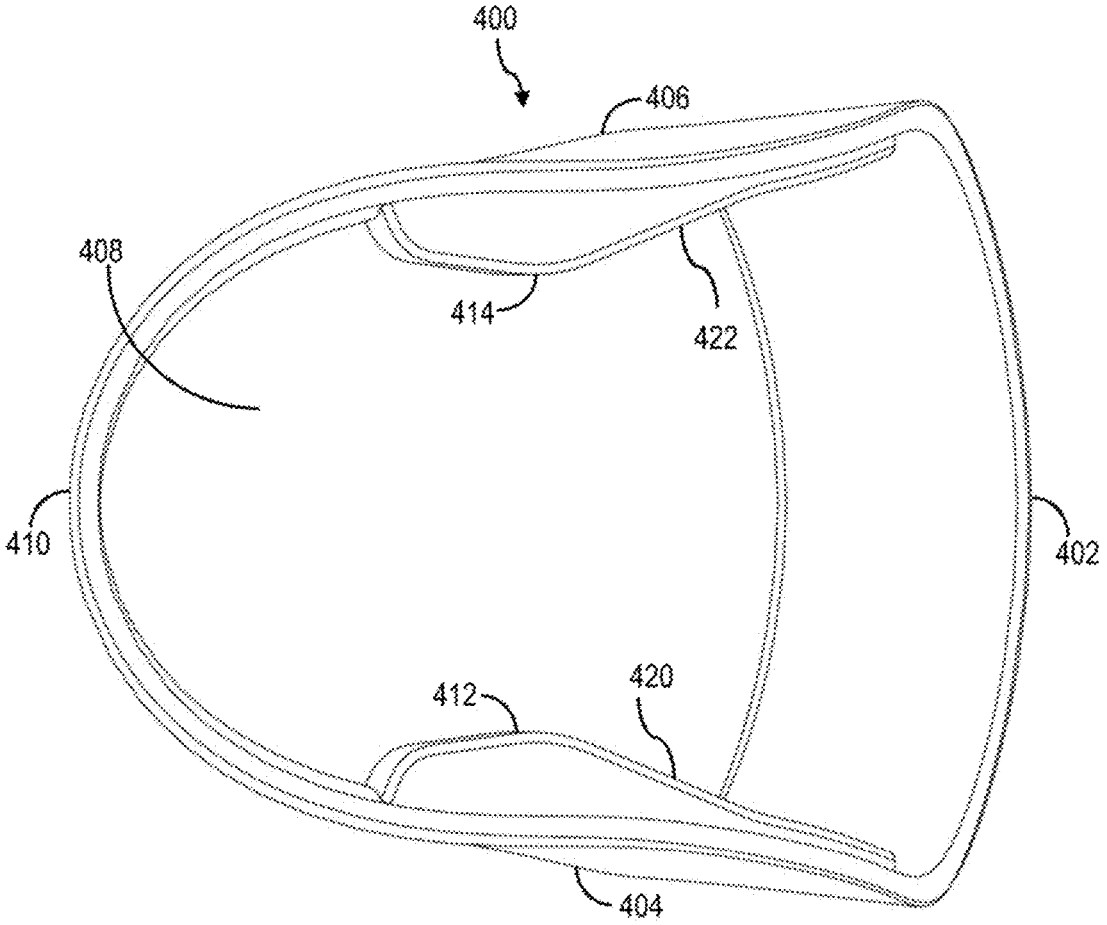
Figure 8E:
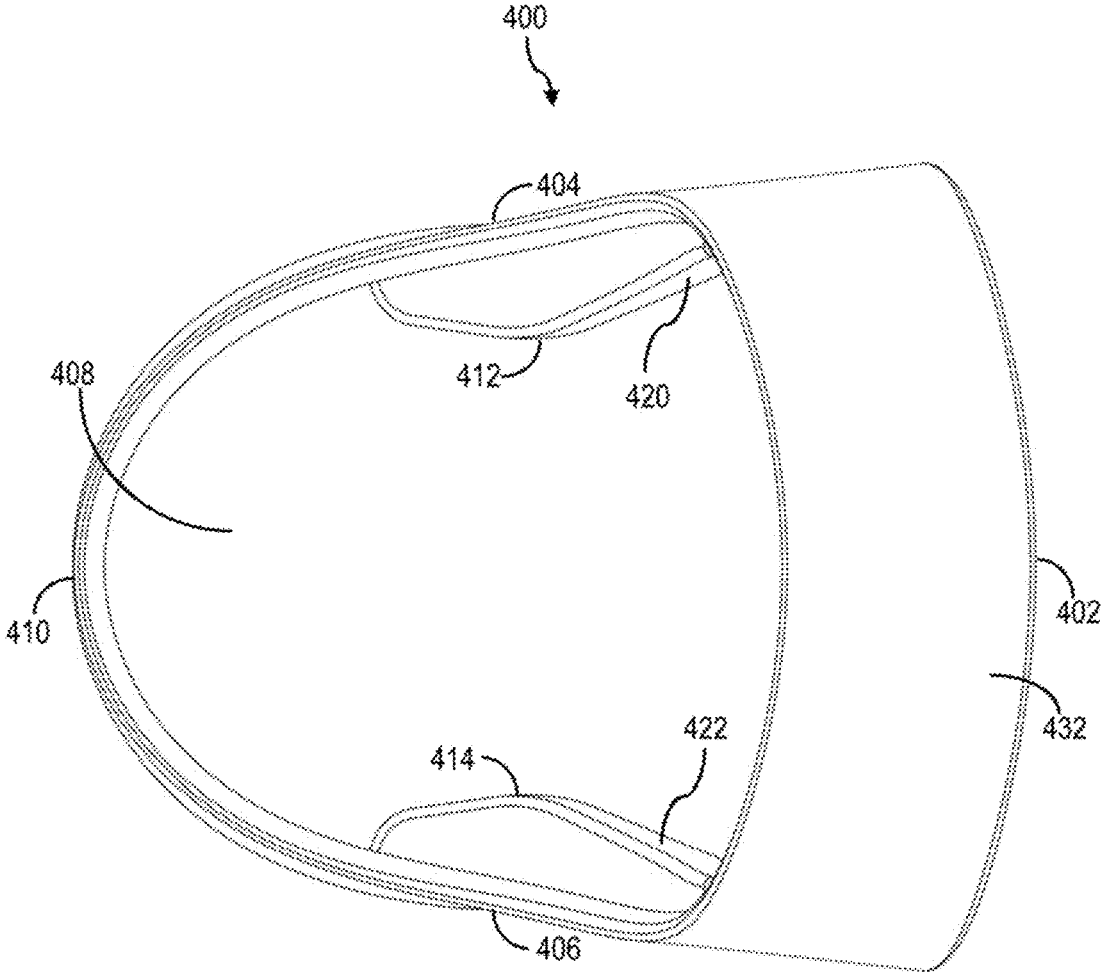

As calculated by Finite Element Analysis, the rigidity of the base 102 is ~365000 lbf/in. This high rigidity allows for the base 102 to withstand human weight distribution and sufficiently support the rearfoot of the user. FIG. 7 shows the testing results for the rigidity of the base 102 obtained from Finite Element Analysis. The rigidity of the base 102 is expressed as the pounds of force required to cause displacement (compression) of the base 102.

The rearfoot support device 100 is absent a front foot support. The absence of the front foot support exposes the front of the foot to the ground or other footwear. Optionally, the rearfoot support device 100 may be absent a back heel. The absence of the back heel exposes the rear of the users heel, for example, to the heel of a shoe or sandal.

Referring back to FIGS. 1-3, the base 102 includes a bottom 132. The bottom 132 is flat and has a high coefficient of friction to prevent the rearfoot from slipping when the support device 100 is used barefoot. For example, the bottom 132 may be coated with a non-slip material. According to an embodiment, the bottom 132 is treaded.

The base 102 includes an anterior end 108 and a posterior end 110. The anterior end 108 is slanted to support the midfoot and reduce collapse of the medial arch 134 allowing for the support device 100 to be used with enclosed footwear (e.g. sneakers, running shoes, boots, etc.), or backless footwear (e.g. flip-flops, sandals), or barefoot. The posterior end 110 of the base 102 is shaped to easily fit into the heel of enclosed footwear.

According to an embodiment, the base 102 includes a lateral section 104 and a medial section 106. The lateral section 102 supports the lateral rearfoot region of the user. The medial section 104 supports the medial rearfoot region of the user.

The support device 100 includes a pair of opposable support members 112, 114. The support members 112, 114 are waterproof and sweatproof. The support members 112, 114 provide stabilizing support on either side of the subtalar joint 128 to effectively lock the subtalar joint 128 in a neutral position thereby preventing excessive pronation and allowing for effective propulsion.

The support members 112, 114 are substantially rigid, but allow for some minimal flexibility depending on the forces exerted by the wearer's rearfoot. To provide sufficient support, the support members 112, 114 are ~5 mm thick. As measured by a compression spring, the support members 112, 114 rigidity is calculated to be 152 lbf/in. Thus, the lateral force caused by the user's foot around the subtalar joint will always be contained between the support members 112, 114 given the rigidity of the support members 112, 114.

According to an embodiment, the support members 112, 114 comprise a lateral support member 112 disposed on the lateral section 104 and a medial support member 114 disposed on the medial section 106.

The support members 112, 114 include concave surfaces 120, 122 shaped to closely contour the natural curvature of the calcaneus 126 (heel bone) as it narrows in width superiorly between the malleolus 130 (bony projections either side of the ankle) and the widest parts of the calcaneus 126. The concave surfaces 120, 122 have a high coefficient of friction thereby enhancing the supportive effect of the support members 112, 114 and the hold of the support device 100 to the rearfoot. For example, the concave surfaces 120, 122 may be coated with a non-slip material. According to an embodiment, the concave surfaces 120, 122 are coated with ethylene vinyl acetate (EVA).

The support device 100 includes interfaces 116, 118 between the support members 112, 114 and the base 102. The interfaces 116, 118 are curved causing the support members 112, 114 to be biased inwards toward each other in order to clamp the rearfoot of the user below the malleolus 130, between the support members 112, 114. The interfaces 116, 118 are also curved to cradle the heel of the user. Thus, the base 102 and support members 112, 114 form a clamp by which the support device 100 stays attached to a user's foot. This configuration is advantageous to keep the support device 100 securely on the foot of the user without the need for straps or another closure system passing over the top of the midfoot.

According to an embodiment, the support device 100, including the base 102 and the opposable support members 112, 114 are custom fitted to the dimensions of the user's foot.

The rearfoot support device 100 is absent a heal support, there is no back to the device. The rearfoot support 100 is absent a front foot support, there is no base that extends to the front of the foot. In an embodiment, the rearfoot support device 100 consists only of the base 102, the lateral section 104 and the medial section 106 as one unit. The lateral section 104 and the medial section 106 do not extend beyond the sides of the heel of the user. The base 102 does not extend beyond the heel of the user.

When used barefoot, the support device 100 performs the function of a heel counter, with the added benefit of not requiring a closure system passing over the midfoot. Thus, the support device 100 has a low profile and can be worn barefoot or with backless footwear without being visibly noticeable. For further concealment, the support device 100 may be provided in a variety of colors matching skin tones.

Now referring to FIG. 3, the support device 100 may be adjusted to better fit and stay attached to a user's foot 124. The lateral section 104 and the medial section 106 are adjustably attached such that and the distance between the support members 114, 116, and the width of the base 102, can be widened or shortened to better clamp the support device 100 to the user's foot 124. The medial section 106 includes a projection 204 and the lateral section 104 includes a cavity 202 for receiving the projection 204. To adjust the distance between the support members 114, 116 (and the width of the base 102), the lateral section 104 may be moved relative to the medial section 106 by moving the projection 204 in/out of the cavity 202.

The ability to adjust the width of the base 102 also allows for the support device 100 to be used with a range of heel sizes. Further, the ability to adjust the support device 100 may be useful to provide temporary support while a user waits for custom orthotics to be made. According to an embodiment, the support device 100 may be compatible for users having a heel size corresponding to a shoe size between size 7 and 11. Other shoe sizes can be included with embodiments of the support device 100.

The height of the base 102, $h_1$, and the height of the projection 204, $h_2$, should be substantially the same, with $h_1$ being only slightly larger than $h_2$. This prevents the formation of a gap between the base 102 and the bottom of the user's foot 124 in the region of the projection 204 that is not within the cavity 202. Accordingly, the weight of the user may be more evenly distributed over the base 102, and in turn, the base 102 evenly supports the user's heel.

Figure 4:
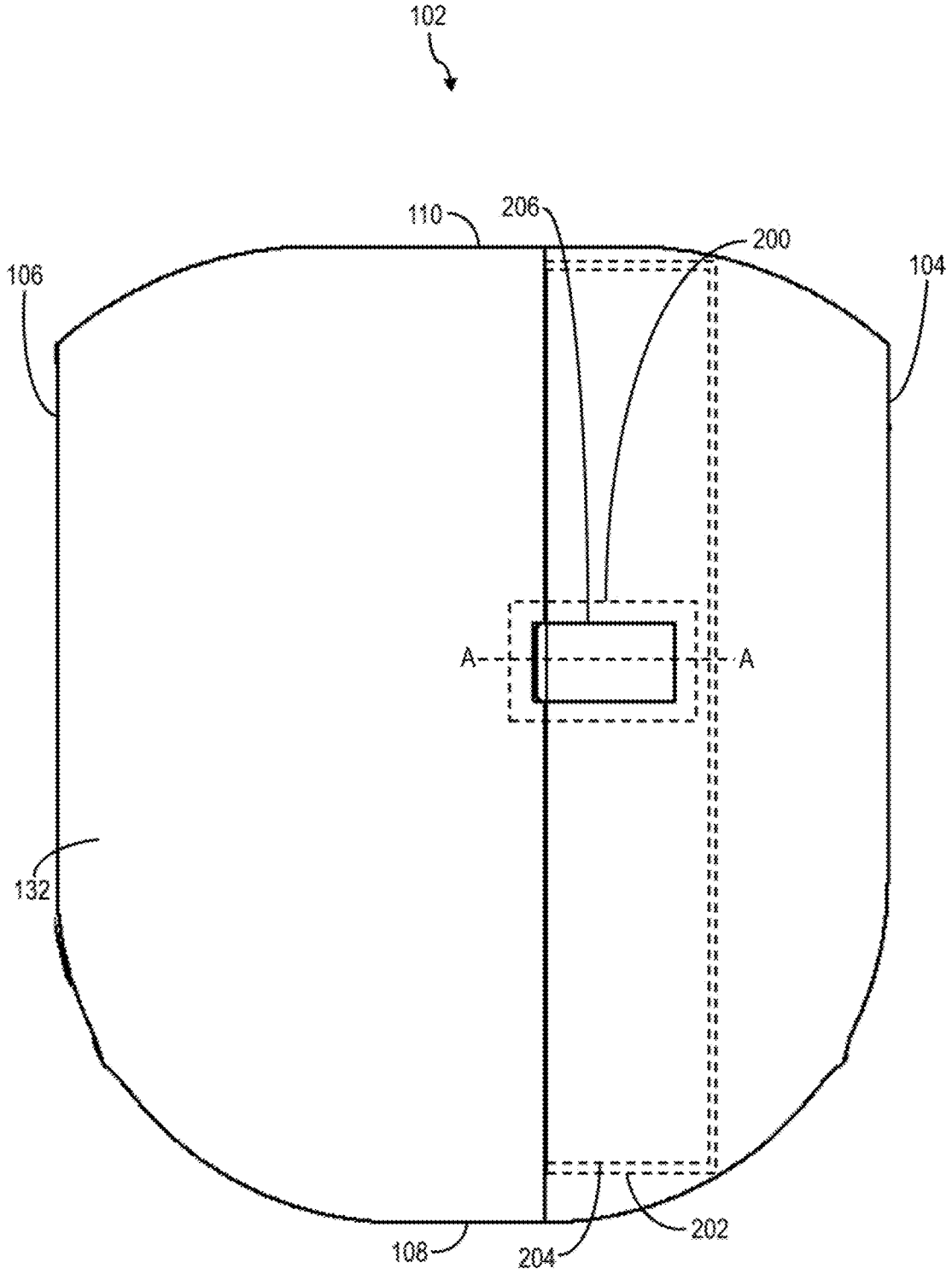
FIG. 4 is a bottom view of a base, according to an embodiment.

Referring to FIG. 4, illustrated therein is a bottom view of the base 102. The cavity 202 and projection 204 span substantially the entire length of the base 102 between the anterior end 108 and the posterior end 110. As noted above, this prevents the formation of a gap between the heel of a user and the base 102.

The base 102 includes a clamp mechanism 200 for adjusting the position of the lateral section 104 relative to the medial section 106, and thereby adjusting the width of the base 102 and the distance between the support members (i.e. support members 114, 116 in FIGS. 1-3).

Figure 5A:
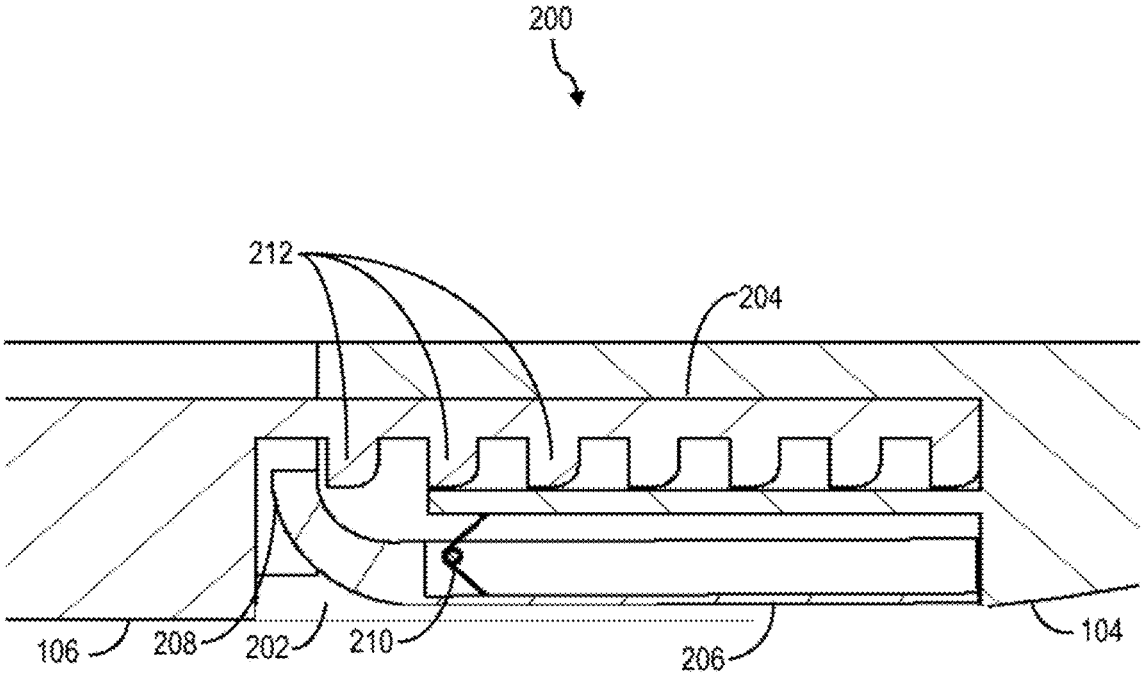
FIG. 5A is a cross-sectional view of a clamp mechanism in a closed position, according to an embodiment.

Referring to FIG. 5A, illustrated therein is a cross-sectional view through section A-A in FIG. 4, showing a clamp mechanism 200 according to an embodiment. The clamp mechanism 200 includes a pawl 208 connected to a lever arm 206 and a spring 210. The pawl 208, lever arm 206 and spring 210 are positioned within the cavity 202 in the lateral section 104. The clamp mechanism 200 includes a plurality of teeth 212 on the projection 204 of the medial section 106.

In the closed position, the pawl 208 is biased by the spring 210 to engage the teeth 212 thereby preventing the lateral section 104 and medial section 106 from moving apart from each other. However, in the closed position, the lateral section 104 and medial section 106 may still be moved together by moving the projection 204 into the cavity 202.

Figure 5B:
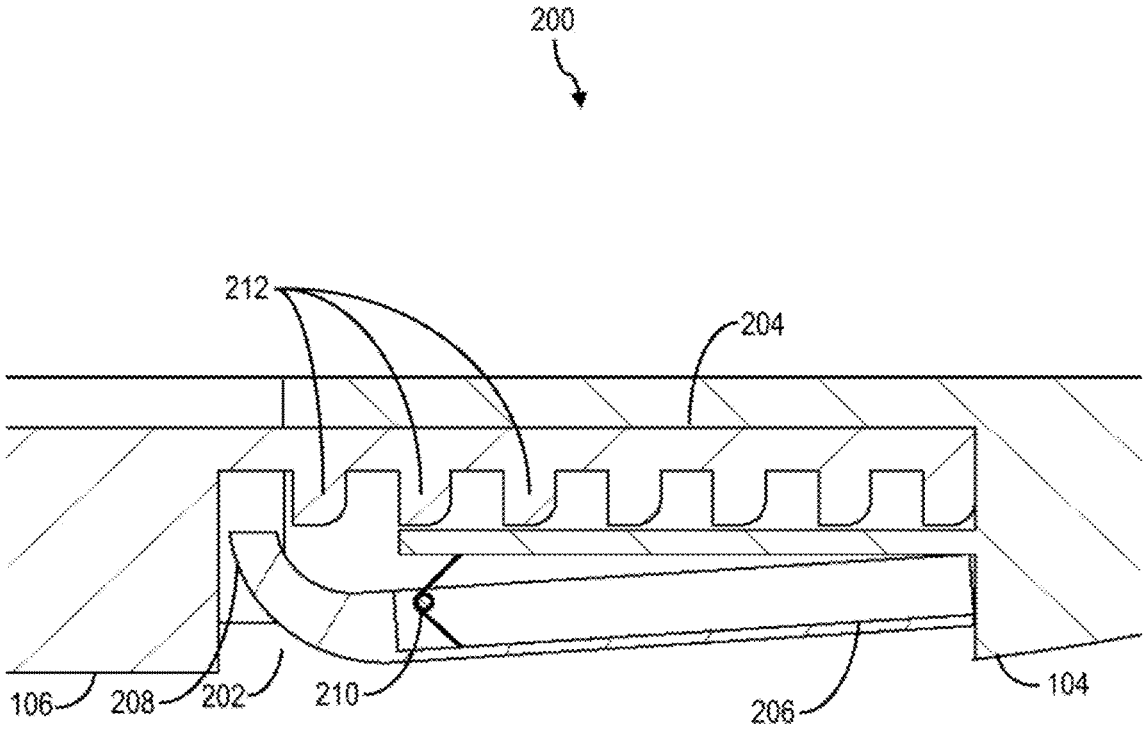
FIG. 5B is a cross-sectional view of the clamp mechanism in an open position.

Referring to FIG. 5B, illustrated therein is a cross-sectional view through section A-A in FIG. 4, showing the clamp mechanism 200 in an open position. In the open position, the bias of the spring 210 is overcome by the user depressing the lever arm 206 thereby disengaging the pawl 208 from the teeth 212. In the open position, the lateral section 104 and medial section 106 may be moved apart, or together, by moving the projection 204 out/into the cavity 202.

Referring back to FIG. 3, the clamp mechanism 200 must be in the open position (FIG. 5B) to increase the width of the base 102 and the distance between the support members 112, 114 to fit the support device 100 onto the rearfoot of the user. The clamp mechanism 200 must be in the closed position (FIG. 5A) to fix the width of the base 102 and the position of the support members 112, 114 to securely clamp the support device 100 to the user's rearfoot.

Referring back to FIG. 4, when the user depresses the lever arm 206 and the clamp mechanism 200 is in the open position (FIG. 5B), the user may grip the lateral section 104 and the medial section 106 pull and apart to increase the width of the base 102, or push together to decrease the width of the base 102. An increase or decrease in the width of the base 102 correspondingly increases or decreases the distance between the support members (i.e. support members 112, 114 in FIGS. 1-3).

In the closed position (FIG. 5A), the lever arm 206 should be flush with the bottom 132 of the base 102 to form a substantially planar surface. According to other embodiments, the lever arm 206 may be disposed on another surface of the base 102. For example, the lever arm 206 may be disposed on the anterior end 110 and connected to the clamp mechanism 200.

It should be noted, the support device 100 shown in FIGS. 1-4 is for use on the right foot of a user. However, none of the foregoing limits the present invention to right foot use only. According to other embodiments, the support device is a mirror image of the support device 100 shown in FIGS. 1-4 and is provided for use on the left foot.

Figure 6A:
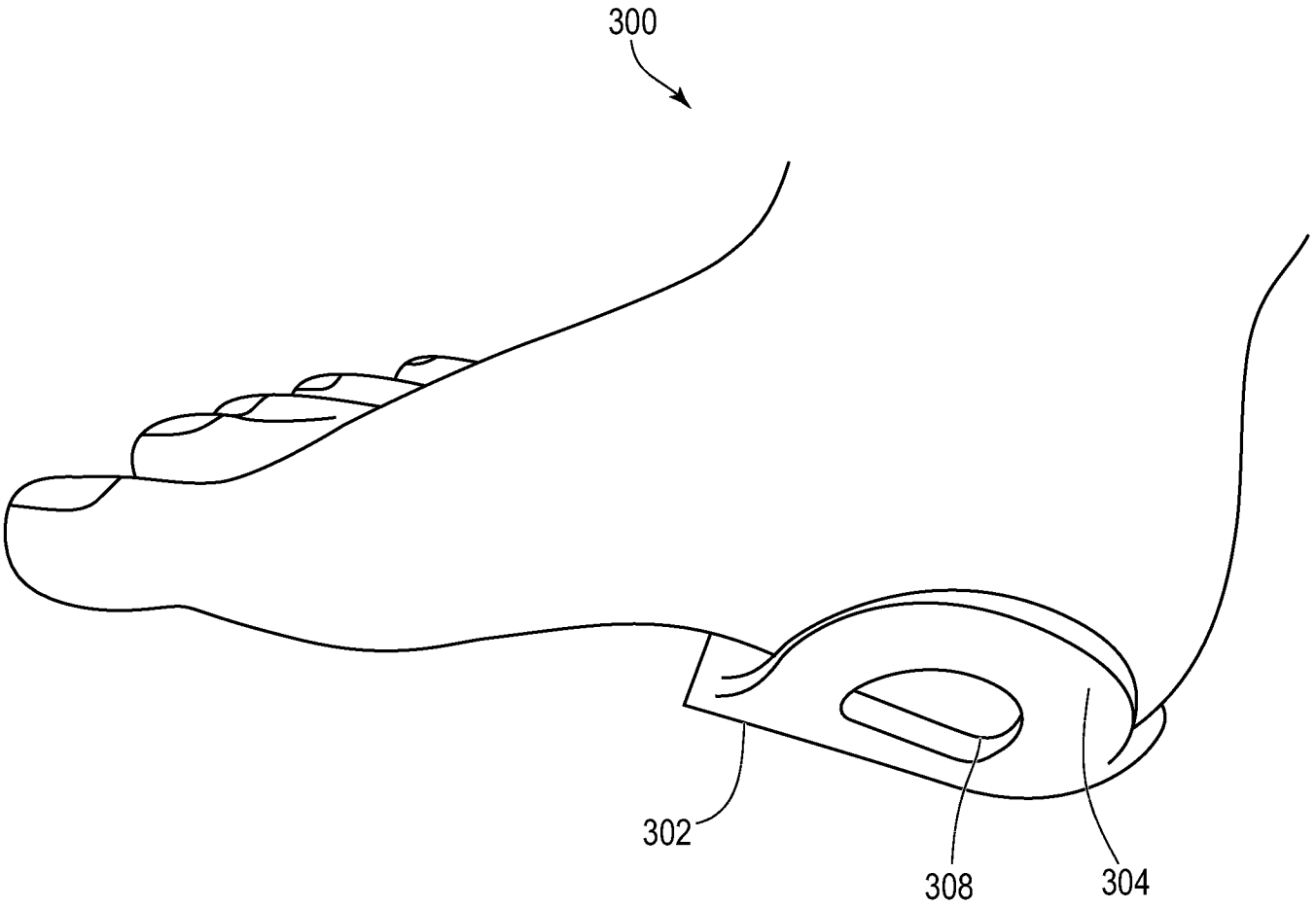
FIG. 6A is a medial side view of a support device, shown attached to a user's foot, according to an embodiment.
Figure 6B:
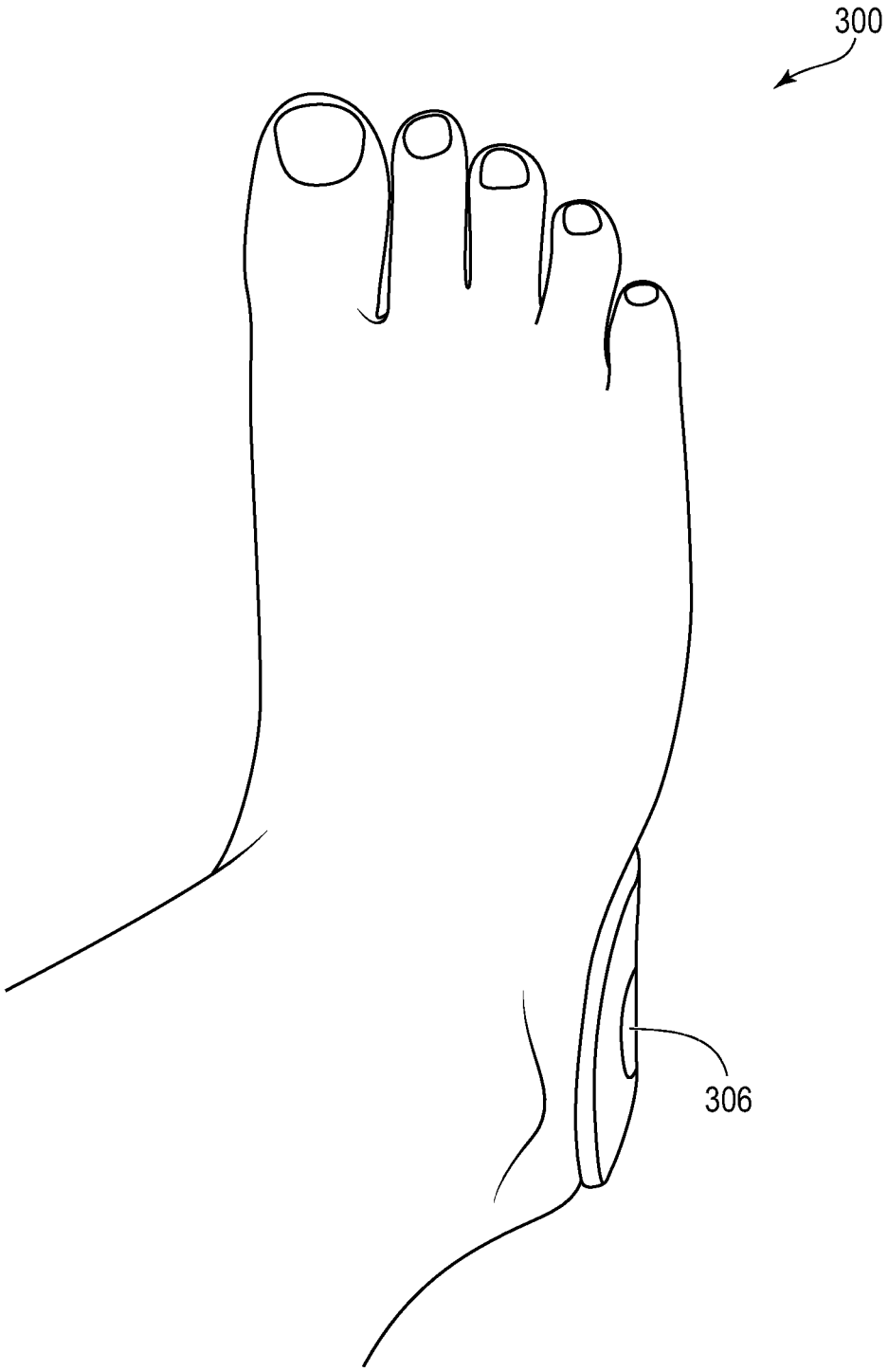
FIG. 6B is a top view of the support device in FIG. 6A.
Figure 6C:
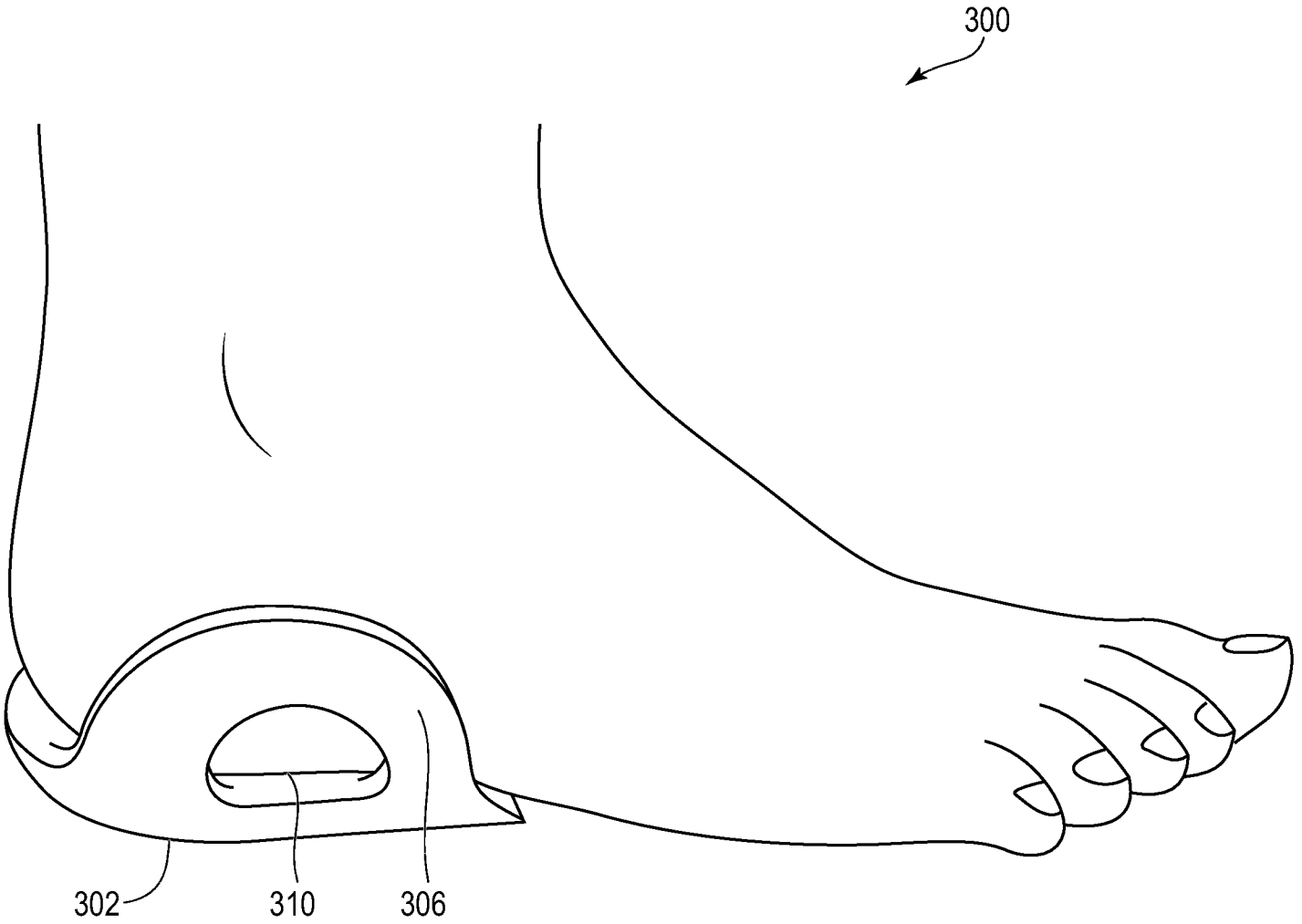
FIG. 6C is a lateral side view of the support device in FIG. 6A.

Referring to FIGS. 6A-6C, illustrated therein are medial side, top and lateral side views, respectively, of a rearfoot support device 300, shown attached to a foot of a user. The support device 300 is substantially similar to the support device 100 in FIGS. 1-4. The support device 300 includes a base 302 and opposable support members 304, 306.

The support device 300 includes cutouts 308, 310 in the support members 304, 306. The cutouts 308, 310 reduce the overall weight of the support device 300 without substantially decreasing the rigidity of the support members 304, 306 and adversely impacting the ability of the support members 304, 306 to lock the subtalar joint in a neutral position. Furthermore, the cutouts 308, 310 may be shaped or angled to concentrate the gripping force of the support members 304, 306 at one or more contact points on the rearfoot of the user, thereby securely clamping the support device 300 to the rearfoot.

Referring to FIGS. 8A-8E, illustrated therein is a perspective view (FIG. 8A), a side view (FIG. 8B), a front view (FIG. 8C), a top view (FIG. 8D) and a bottom view (FIG. 8E), respectively, of a rearfoot support device 400, according to an embodiment.

The support device 400 includes a base 402, a posterior end 410 and opposable support members 412, 414 disposed on a lateral section 404 and a medial section 406, respectively. The support device 400 is both waterproof and sweatproof. Preferably, the support device 400 is constructed of nylon and EVA, to be sufficiently rigid to withstand the weight of the user and sufficiently support the rearfoot of the user. The base 402, the posterior end 410, the lateral section 404 and the medial section 406 may be constructed as a single piece of nylon.

The base 402 includes a bottom 432. The bottom 432 is flat and has a high coefficient of friction to prevent the rearfoot from slipping when the support device 400 is used barefoot. For example, the bottom 432 may be coated with a non-slip material. According to an embodiment, the bottom 432 is treaded. Generally, the base 402 is not as thick as the base 102 in FIGS. 1-4, allowing for an aesthetically "low profile" appearance when the support device 400 is worn (see FIGS. 9A-10C) allowing for the support device 400 to be used with enclosed footwear (e.g. sneakers, running shoes, boots, etc.), or backless footwear (e.g. flip-flops, sandals), or barefoot. The posterior end 410 and the base 402 are shaped to easily fit into the heel of enclosed footwear.

Similar to the support device 300 (FIGS. 6A-6C), the support device 400 provides a material and weight reduction (compared to support device 100 in FIGS. 1-4), by the lateral section 404 and medial section 406 connecting the base 402 to the posterior end 410 leaving an opening 408 for the user's heel. In the support device 400, rearfoot support is provided by the combination of the base 402 and the posterior end 410 that wrap around the user's heel (see FIG. 8B) and the lateral and medial sections 404, 406 which stabilize the subtalar joint.

The lateral section 404 and the medial section 406 are substantially rigid, but allow for some minimal flexibility depending on the forces exerted by the wearer's rearfoot. To provide sufficient support, the lateral section 404 and medial section 406 are ~3 mm thick. Thus, the lateral force caused by the user's foot around the subtalar joint will always be contained between the sections 404, 406 given the rigidity of the sections 404, 406.

The lateral section 404 and the medial section 406 are biased inwards toward each other in order to clamp the rearfoot of the user below the malleolus 130, between the support members 412, 414. Thus, the base 402, the posterior end 410 the lateral section 404 and the medial section 406 form a clamp by which the support device 400 stays attached to a user's foot. This configuration is advantageous to keep the support device 400 securely on the foot of the user without the need for straps or another closure system passing over the dorsal aspect (top) of the midfoot, and further contributes to the aesthetic "low profile" appearance when the support device 400 is worn barefoot or with footwear.

The support device 400 includes a pair of opposable support members 412, 414. The support members 412, 414 are waterproof and sweatproof and constructed of EVA foam. The support members 412, 414 provide stabilizing support on either side of the subtalar joint 428 to effectively lock the subtalar joint 428 in a neutral position thereby preventing excessive pronation and allowing for effective propulsion. Stabilizing the subtalar joint 428 in a neutral position consequently causes the medial longitudinal arch 434 to rise as indicated by arrow 450. Thus, the support device 400 indirectly reduces medial arch 434 collapse by stabilizing the subtalar joint 428.

The thickness of the support members 412, 414, is generally ~2-5 mm, but may be varied to accommodate the user's foot size or shoe size (if the device 400 is used with footwear). According to some embodiments, the support members 412, 414 may be further padded or cushioned for user comfort. According to an embodiment, the support members 412, 414 may be joined across the posterior end 410 and form a single support member.

The support members 412, 414 include concave surfaces 420, 422 shaped to closely contour the natural curvature of the calcaneus 426 (heel bone) as it narrows in width superiorly between the malleolus 430 (bony projections either side of the ankle) and the widest parts of the calcaneus 426. The concave surfaces 420, 422 have a high coefficient of friction thereby enhancing the supportive effect of the support members 412, 414 and the hold of the support device 400 to the rearfoot. For example, the concave surfaces 420, 422 may be coated with a non-slip material. According to an embodiment, the concave surfaces 420, 422 are coated with EVA.

According to an embodiment, the support device 400, including the base 402, the posterior end 410, the lateral and medial sections 404, 406 and the opposable support members 412, 144 are custom fitted to the dimensions of the user's foot.

Figure 9A:
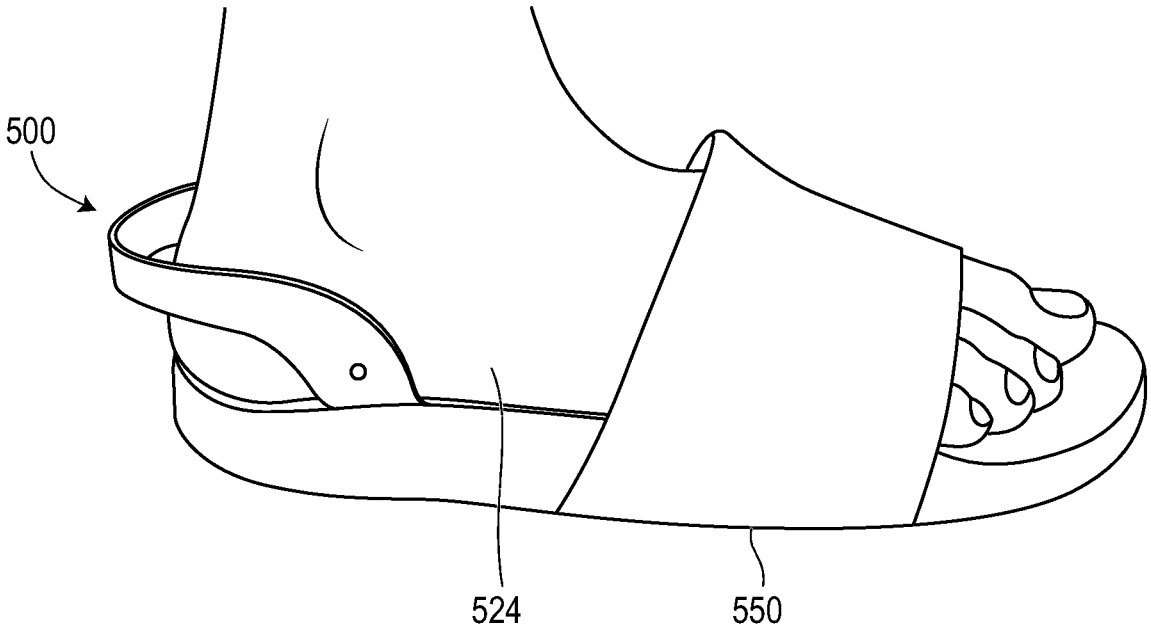
FIGS. 9A-9C are a side, back and front views, respectively, of a rearfoot support device used with backless footwear, according to an embodiment.
Figure 9B:
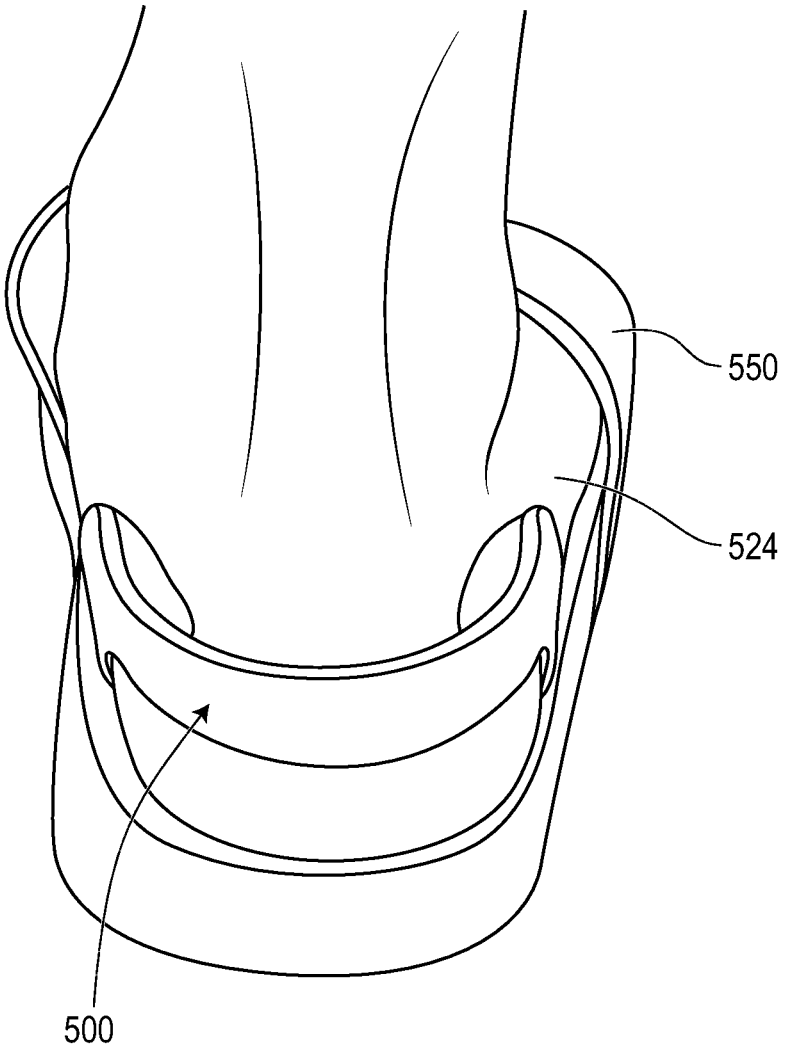
Figure 9C:
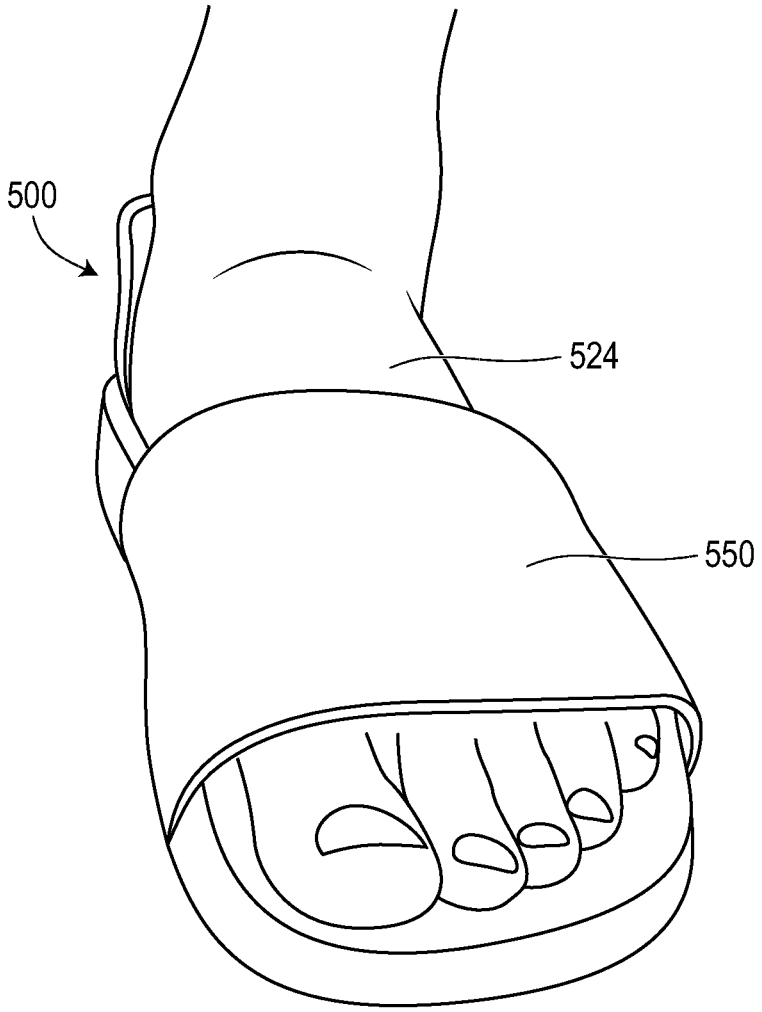

Referring to FIGS. 9A-9C, shown therein is a rearfoot support device 500, used with backless footwear 550, according to an embodiment. Backless footwear 550 includes sandals, flip-flops, or the like, lacking a closed heel to support the user's rearfoot region. Accordingly, the support device 500 may be used while wearing backless footwear 550, to provide rearfoot support to the user's foot 524. The support device 500 may be the support device 400 in FIGS. 8A-8E.

Figure 10A:
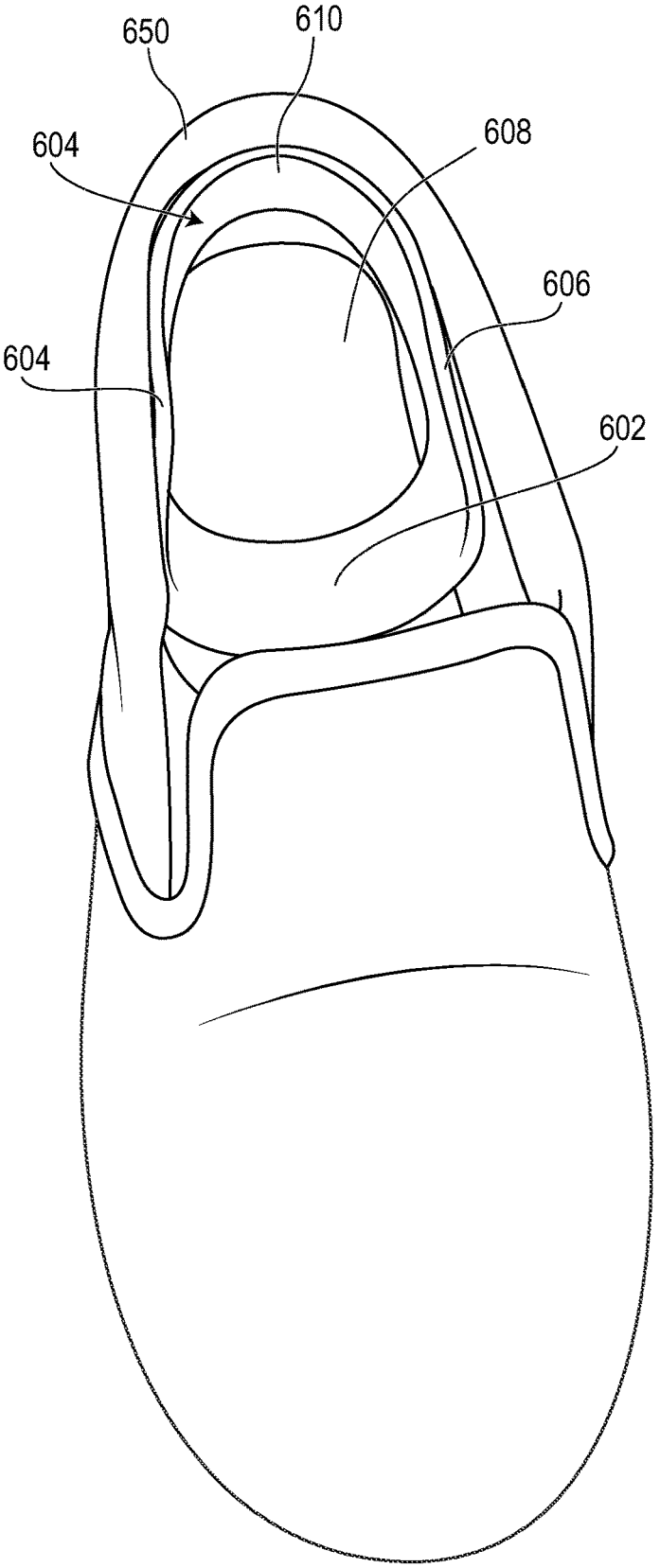
FIG. 10A is a top view of a rearfoot support device for use with enclosed footwear, according to an embodiment.
Figure 10B:
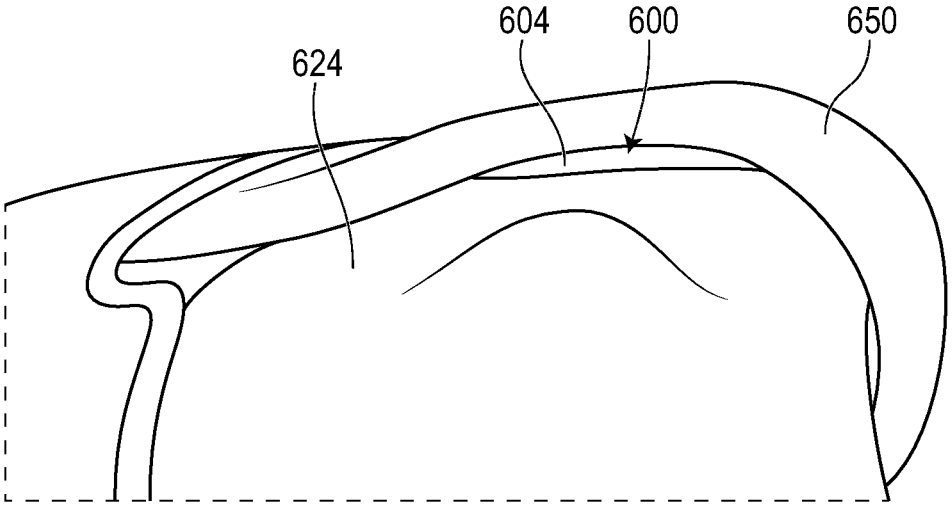
FIG. 10B is a top lateral view of the rearfoot support device in FIG. 10A used with enclosed footwear.
Figure 10C:
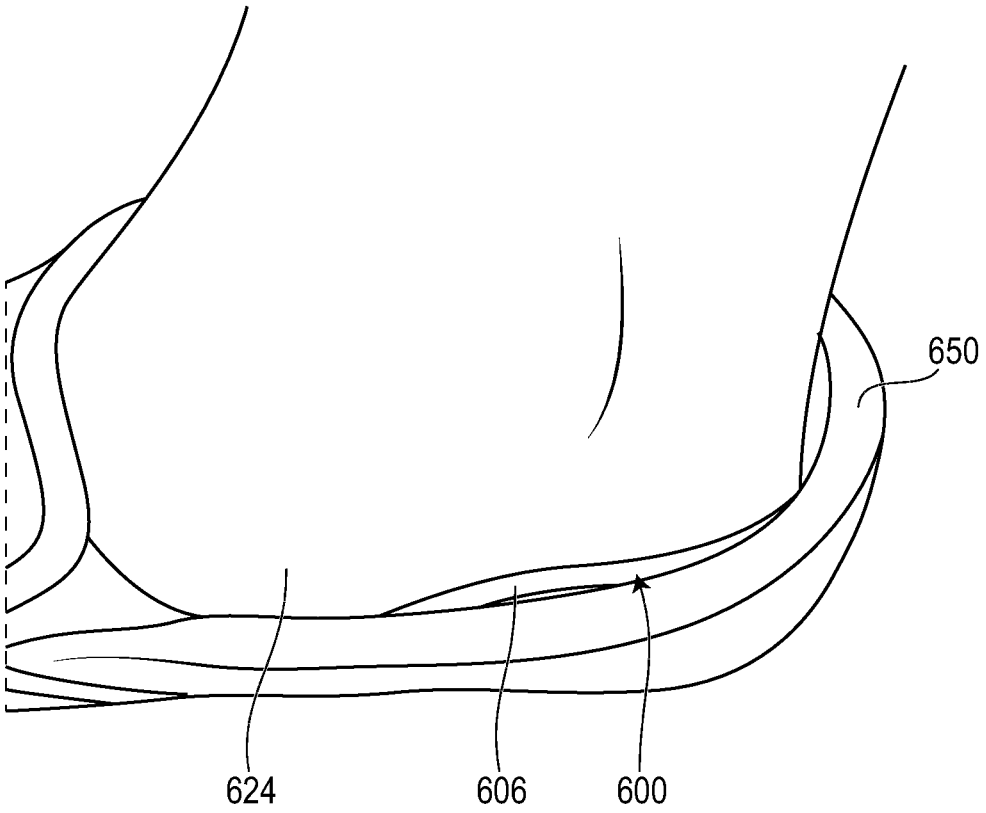
FIG. 10C is a top medial view the rearfoot support device in FIG. 10A used with enclosed footwear.

Referring to FIG. 10A, illustrated therein is a top view of a rearfoot support device 600 for use with enclosed footwear 650, according to an embodiment. Enclosed footwear 650 includes shoes, boots, or the like, that have an enclosed heel. The support device 600 is constructed to be generally thinner than the support devices 400, 500 so as not to appreciably lengthen or widen a user's foot while wearing the device 600, thus allowing the support device 600 to fit into the heel of the user's enclosed footwear 650. According to other embodiments, the support device 600 may be worn by the user barefoot (i.e. without wearing footwear).

The support device 600 is substantially similar to the support devices 400, 500 described above. The support device 600 includes a base 602, a posterior end 610 a lateral section 604, a medial section 606 and an opening 608. The support device 600 does not include support members (i.e. support members 412, 414 in FIGS. 8A-8E) and the lateral and medial sections 604, 606 directly clamp the user's foot 624 to stabilize the subtalar joint (see FIGS. 10B-10C).

The lateral and medial sections 604, 606 may include concave surfaces shaped to closely contour the natural curvature of the calcaneus (heel bone) as it narrows in width superiorly between the malleolus (bony projections either side of the ankle) and the widest parts of the calcaneus. The concave surfaces may be contoured to fit a particular shoe size.

The lateral and medial sections 604, 606 may be coated with a material having a high coefficient of friction thereby enhancing the hold of the support device 600 to the rearfoot. For example, the lateral and medial sections 604, 606 may be coated with a non-slip material such as EVA. EVA foam may further provide cushioning and conform to the user when applied up to a thickness of ~2 mm on the lateral and medial sections 604, 606.

While the above description provides examples of one or more apparatus, methods, or systems, it will be appreciated that other apparatus, methods, or systems may be within the scope of the claims as interpreted by one of skill in the art.

The invention claimed is:

1. A rearfoot support device for use without footwear, the device comprising:

a flat base for supporting a heel of a user;

opposable inwardly biased lateral and medial sections extending posteriorly from the base, the lateral and medial sections being joined at a posterior end and not extending anterior of the base, wherein the base and the lateral and medial sections are formed of a first material;

the lateral and medial sections defining a through opening between the base and the posterior end;

a first support member coupled to the lateral section and having a first inner surface; and a second support member coupled to the medial section and having a second inner surface, wherein the first and second inner surfaces extend towards each other, wherein the first and second support members are configured to support a subtalar joint of the user, and wherein the first and second support members are formed of a second material different than the first material;

wherein the base and the first and second support members are configured to clamp the rearfoot of the user therebetween to stabilize the subtalar joint in a neutral position without use of footwear and without wrapping around a dorsal aspect of a foot of the user.

2. The device of claim 1, wherein the support device further comprises:

a mechanism for adjustably moving the lateral section relative to the medial section.

3. The device of claim 2, wherein the mechanism comprises:

a projection on the lateral section, wherein the projection includes a plurality of teeth spaced at increments; and a cavity in the medial section, wherein the cavity comprises:

a spring-biased pawl for engaging the teeth; and a lever arm connected to the pawl.

4. The support device of claim 3, wherein a width of the base is adjustable by moving the lateral section relative to the medial section upon depressing the lever arm.

5. The support device of claim 1, wherein the support members include concave surfaces shaped to fit the contours of the calcaneus as it narrows in width superiorly between the malleolus and the widest parts of the calcaneus.

6. The support device of claim 5, wherein the concave surfaces of the support members are coated with a material having a high coefficient of friction.

7. The support device of claim 6, wherein the material is ethylene vinyl acetate.

8. The support device of claim 1, wherein the posterior end is shaped to wrap around a back of the foot.

9. The support device of claim 1, wherein the base comprises a bottom coated with a material having a high coefficient of friction.

10. The support device of claim 1, wherein the base has a minimum thickness of ~10 mm.

11. The support device of claim 1, wherein the base has a rigidity of ~365000 lbf/in.

12. The support device of claim 1, wherein the support members each have a thickness of ~2-5 mm.

13. The support device of claim 1, wherein the support members each have a rigidity of ~152 lbf/in.

14. The support device of claim 1 wherein the base extends continuously between the lateral and medial sections such that the base, the lateral and medial sections, and the posterior end together define a continuous structure.

15. The support device of claim 1 wherein the posterior end has a height above the base, and wherein the lateral and medial sections do not extend substantially above the height of the posterior end above the base.

16. The support device of claim 15 wherein the base extends continuously between the lateral and medial sections such that the base, the lateral and medial sections, and the posterior end together define a continuous structure.

* * * * *